US006202922B1

(12) United States Patent
Phillips et al.

(10) Patent No.: US 6,202,922 B1
(45) Date of Patent: Mar. 20, 2001

(54) WASTE RECEPTACLE

(76) Inventors: Carol O. Phillips; Lindsey Jasmine Phillips; Janine Marie Phillips, all of 100 Howell Landing, Duluth, GA (US) 30096

( * ) Notice: Subject to any disclaimer, the term of this patent is extended or adjusted under 35 U.S.C. 154(b) by 0 days.

(21) Appl. No.: 09/351,475

(22) Filed: Jul. 13, 1999

(51) Int. Cl.[7] ..... B65D 91/00
(52) U.S. Cl. ..... 232/43.1; 220/908
(58) Field of Search ..... 232/43.1, 43.3, 232/43.5; 220/908, 404, 407, 409

(56) References Cited

U.S. PATENT DOCUMENTS 814,563 * 3/1906 Pond .
2,907,516 * 10/1959 Follett et al. .
4,081,105 * 3/1978 Dagonnet et al. .
4,418,835 * 12/1983 Watts .
4,823,979 * 4/1989 Clark, Jr. .
4,953,744 * 9/1990 Koyama .
5,007,581 * 4/1991 Douglas .
5,090,785 * 2/1992 Stamp .
5,348,222 * 9/1994 Patey .
5,361,978 * 11/1994 Monroe .

* cited by examiner

*Primary Examiner*—Terry Lee Melius
*Assistant Examiner*—William L. Miller
(74) *Attorney, Agent, or Firm*—Bernstein & Associates; Jason A. Bernstein; John W. Greenwald

(57) ABSTRACT

A container with a front opening and a top opening, and a top wall preferably hinged to the container to cover the top opening. A hinged front wall covers the front opening and has a curved guide rail extending therefrom which is slidingly received in a curved guide channel formed in the left or right wall, with the rail having a knob for manually pivoting the front wall. A cross-bar assembly preferably comprises two parallel top rods with rollers, two parallel bottom rods with rollers, and two sets of two diagonal cross-rods, the rods interconnected such that the top rods move upward when the diagonal rods pivot upon the application of a force to the bottom rods. An actuator assembly preferably comprises a lever with a foot pedal coupled thereto. A linkage assembly is preferably coupled to the lever and the bottom rods, such that depressing the pedal actuates the linkage assembly to pull the bottom rods inward which moves the top rods upward against the bottom wall to raise the container. A bag opener and holder assembly is preferably provided and comprises fixed and slide arms with knobs extending from the left and right walls.

37 Claims, 10 Drawing Sheets

WASTE RECEPTACLE

FIELD OF THE INVENTION

The present invention relates generally to waste receptacles, and more particularly, to a waste receptacle providing a swinging front door, a mechanism for raising the receptacle with a foot pedal, and a slide arm bag opener and holder assembly.

BACKGROUND OF THE INVENTION

Removing a bag full of refuse from a waste receptacle for later disposal is a routine task for most persons. Such refuse removal can be an arduous, if not impossible task, however, for many individuals such as persons with bad backs, elderly, persons, disabled and/or wheelchair bound persons, and persons with physical limitations.

A number of waste receptacles have been developed for providing ease of removal of the refuse bag from the receptacle. For example, several known receptacles provide a hinged door that swings open in one or another direction, including those described in U.S. Pat. No. 4,953,744 to Koyama, U.S. Pat. No. 5,007,581 to Follet et al., and U.S. Pat. No. 5,361,978 to Monroe. None of these receptacles, however, provides a swinging door that can be provided of a lightweight material and still retain a smooth and stable swinging motion downward or a mechanism adapted for ease of opening and closing such a door by a person with limited physical abilities.

More specifically, the Koyama device has a ramp that automatically ejects the bag from the receptacle upon opening of the horizontally swinging two front doors, which can be dangerous for persons with limited agility who may not be able to move out of the way. The Follet et al. device, which is intended for use as a hospital cart, has a ramp that automatically ejects objects from the receptacle upon opening of the front door which swings upward and thereby poses similar concerns as the Koyama device. The Monroe device has a front door that is initially pulled downward until the door swings outward sufficiently so that the weight of the door and the bag causes gravity to force the door and bag to swing down to the floor to an open position. This device also poses safety concerns for persons with limited abilities who could be injured by the heavy metal door falling upon them.

There is also known the waste receptacle of U.S. Pat. No. 2,907,516 to Ma, as well as the receptacle of Follet et al. mentioned heretofore, which each disclose a waste receptacle with a foot pedal and an actuating mechanism for operating a hinged door. However, neither of these foot pedals and actuating mechanisms are employed in a manner other than for opening a hinged door, and as such do not obviate the need to engage in a lifting activity of a weighted refuse bag at some point during the carrying disposal of the bag.

Accordingly, what is needed but not found in the prior art is a mobile waste receptacle having a hinged, lightweight, front door that swings down such that it can be smoothly, stably, and easily operated, that raises upon actuation of a foot pedal to thereby obviate the need to bend over and lift a full refuse bag up and out of the receptacle and to also obviate the need to engage in any lifting activity after removal of the weighted refuse bag from the receptacle, and that provides a mechanism for opening and supporting a new refuse bag upon disposal of the previous bag.

SUMMARY OF THE INVENTION

Generally described, the present invention provides a waste receptacle comprising a container with a front opening and a top opening formed by a right wall, a left wall, a rear wall, and a bottom wall. The container preferably has two front feet attached to the container for stability and two rear wheels rotatably mounted to the container to provide mobility. The rear wall preferably has a pivotable handle for pushing or pulling the container.

A front wall capable of substantially covering the front opening is preferably hinged to the bottom wall. The front wall preferably has at least one curved guide rail extending therefrom, and at least one elongated curved guide channel is formed in the left or right wall to slidingly receive the guide rail and permit a range of stable angular movement of the front wall. At least one slot is preferably provided through the left or right wall and connecting to the channel, and at least one knob preferably extends from the guide rail and through the slot. The knob may thus be grasped by a user to manually swing the front wall down and open to laterally remove a full and weighted refuse bag. It should be noted that the receptacle may be provided with any number of guide rails and channels as may be desired, or may be provided without guide rails and channels.

A top wall capable of substantially covering said top opening is preferably hinged to the container. The top wall preferably has an opening for receiving refuse therethrough and a handle for lifting the top wall.

A cross-bar assembly is preferably provided and arranged generally within a bottom recess formed in the bottom wall of the container. The cross-bar assembly preferably comprises two generally parallel top rods each having a roller disposed thereabout for engaging the bottom side of the bottom wall, and each top rod having a first and second end. Preferably two generally parallel bottom rods are provided with each having a roller disposed thereabout for engaging a floor surface, and each having a first and second end. A first set of two diagonal rods are pivotally coupled at an intermediate portion thereof, each first diagonal rod having a top end coupled to one of the top rod first ends and each first diagonal rod having a bottom end coupled to one of the bottom rod first ends. A second set of two diagonal rods are pivotally coupled at an intermediate portion of each second diagonal rod, each second diagonal rod having a top end coupled to one of the top rod second ends and each second diagonal rod having a bottom end coupled to one of the bottom rod second ends. The top rods thereby move generally upward when the diagonal rods are pivoted, which pivoting may be caused by the application of a force to the bottom rods.

An actuator assembly is preferably provided for generating such a force to be translated to the cross-bar assembly. The actuator assembly preferably comprises a lever extending through a slot in the left or right wall, with a foot pedal coupled to the lever. A linkage assembly is preferably provided and arranged generally within said recess, for translating the force from the pedal to the cross-bar assembly. The linkage preferably comprises a plurality of spools with flexible cords disposed thereabout forming a pulley system. The cords are coupled to the lever and the bottom rods such that depressing the pedal actuates the linkage assembly to pull the bottom ends inward towards each other which causes a raising movement of the top rods against the bottom wall to raise the container.

A bag opener and holder assembly is preferably provided and arranged within the container. The bag opener and holder assembly preferably comprises a fixed right arm and knob extending from the right wall and a fixed left arm and knob extending from the left wall. There is further provided an elongated opening in the right wall and a right slide arm and knob extending through the right wall opening, and an elongated opening defined in the left wall and a left slide arm and knob extending through the left wall opening. A rod is preferably provided mounted within the container for holding a roll of plastic refuse bags.

To install a refuse bag in the container, the bag is partially removed from the bag roll mounted in the container, a top end of the bag is folded over the fixed and slide knobs, the slide knobs are moved toward the front of the container to open the bag, and a bottom end of the bag is detached from the bag roll. The knobs support the bag and retain it in an open position for receiving refuse therein.

To remove the bag from the container for disposal, the top wall is swung open and the slide knobs moved toward the back of the container to close and seal the bag. The user then depresses the pedal to raise the container and the weighted bag to an elevated position such that bending over to lift the weighted bag is not necessary for removal from the container. The user may then disengage the latch and manually move the optional knob on the guide rail to swing down the front wall such that the user may with little to no physical stress move the weighted bag laterally out of the container through the front opening. Because the weighted bag is then in an elevated position, there is no need to lift the bag to remove it from the container to carry it to a disposal site.

To install another bag, the user simply swings the front wall back up to cover the front opening, which thereby latches the front wall in place. The above-described procedure for dispensing a new bag is then repeated.

Accordingly, it is an object of the present invention to provide a waste receptacle that is mobile, lightweight, stable, and provides ease of removal and disposal of a refuse bag contained therein.

It is another object of the present invention to provide a waste receptacle that allows for ease of refuse bag removal by way of a lightweight, hinged front door that smoothly and stably swings down upon manual operation of a knob, which operation can performed by all persons.

It is yet another object of the present invention to provide a mechanism for easily raising the waste receptacle to obviate the need to bend over and lift a full refuse bag, by providing a cross-bar mechanism linked to a foot pedal such that actuation of the foot pedal engages the cross-bar mechanism to raise the receptacle.

It is still a further object to provide for ease of opening and supporting a new refuse bag upon disposal of the previous bag by providing fixed and sliding arms disposed within the waste receptacle.

These and other objects, features, and advantages of the present invention are discussed or apparent in the following detailed description of the invention, in conjunction with the accompanying drawings and the appended claims.

BRIEF DESCRIPTION OF THE DRAWINGS

The various features and advantages of the invention will be apparent from the attached drawings, in which like reference characters designate the same or similar parts throughout the figures, and in which.

DETAILED DESCRIPTION OF THE PREFERRED EMBODIMENTS

Figure 1:
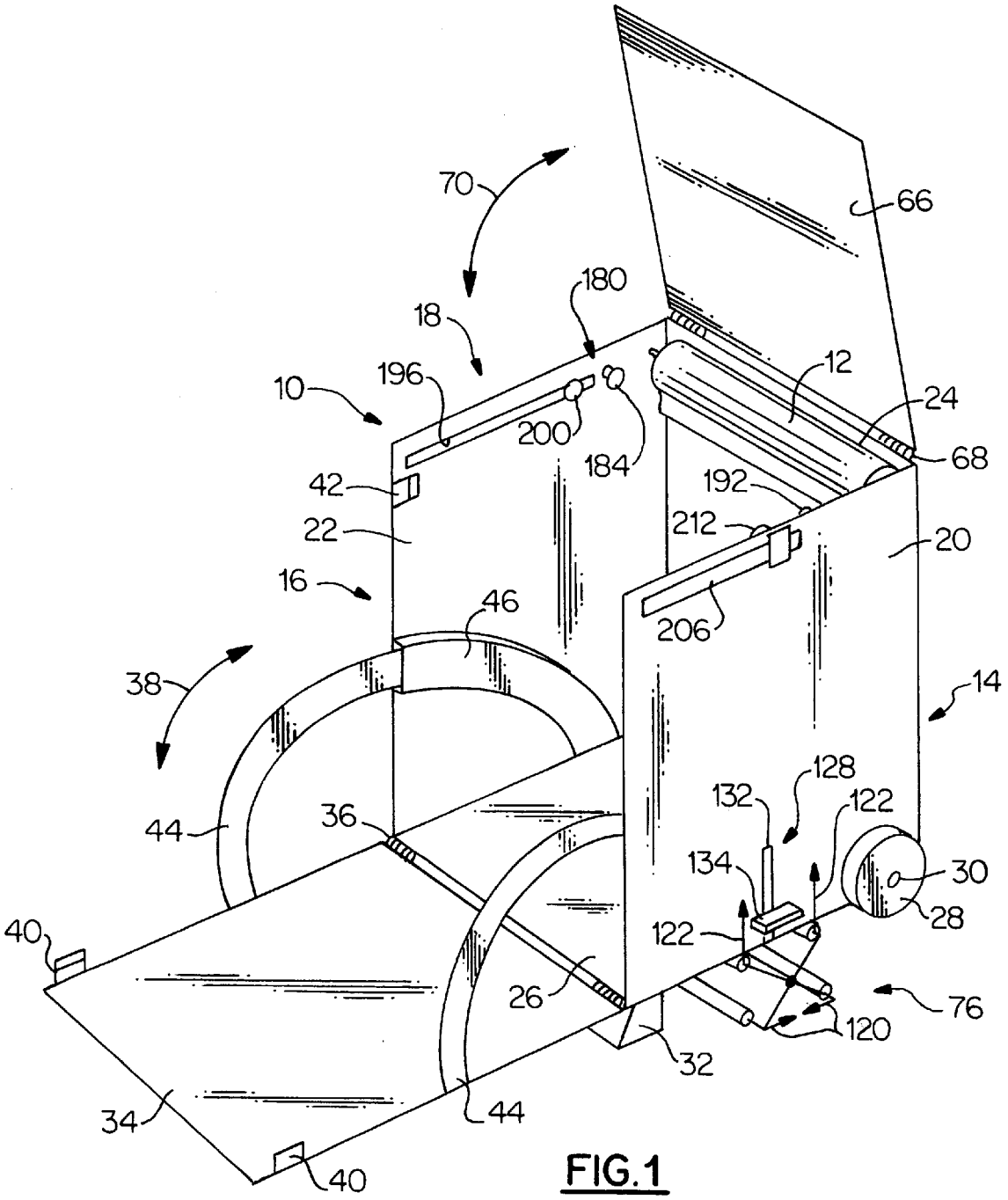
FIG. 1 is a perspective view of a first preferred embodiment of the present waste receptacle.

Referring to FIG. 1 here and throughout, there is illustrated a first preferred embodiment of the present invention, providing a waste receptacle 10 for use generally with plastic or like flexible refuse bags 12 for receiving and storing refuse. The receptacle 10 may be adapted for a variety of uses, including household, industrial, medical and other uses. The use of refuse bags 12 in conjunction with the receptacle 10 is preferable for sanitary reasons, though the receptacle also provides benefits when used without refuse bags 12.

The receptacle 10 has a container 14 with a front opening 16 and a top opening 18 formed by a right wall 20, a left wall 22, a rear wall 24, and a bottom wall 26. The container 14 is preferably provided with the walls 20, 22, 24, and 26 made of a thermoplastic resin, a metal, a composite, or a like material selected for light weight and high strength, and is preferably integrally formed by molding or other fabrication techniques known to those skilled in the art. Preferably, the container 14 is generally cuboidal, though it may have a generally cylindrical, hexagonal, or other regular or irregular shape.

At least one and preferably two wheels 28 are provided rotatably mounted on an axle 30 extending from the container 14, and at least one and preferably two feet 32 extend from the bottom wall 26. The wheels 28 and feet 32 are sized and positioned to provide stability and portability of the container 14.

Figure 2:
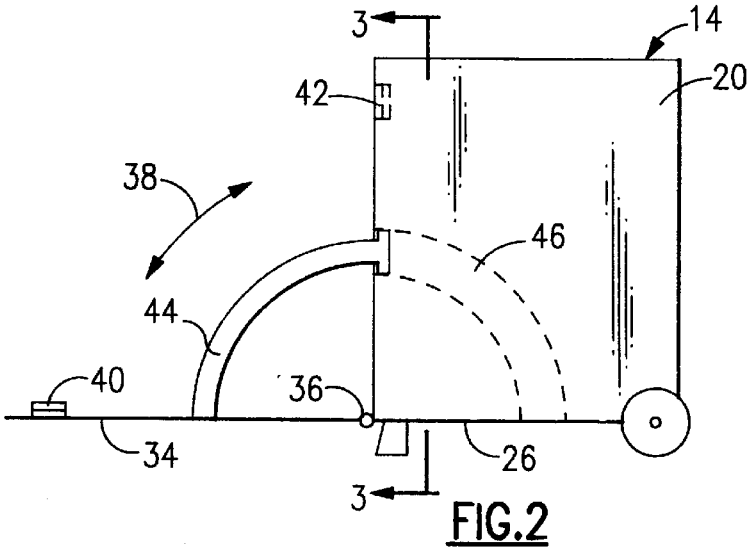
FIG. 2 is a right side view of the receptacle.

Referring now to FIG. 2, a front wall 34 is provided of a material and construction preferably similar to the container walls 20, 22, 24, and 26, and of a size and shape to substantially cover the front opening 16. The front wall 34 is preferably coupled to the bottom wall 26 by at least one hinge 36 or like mechanism permitting a range of angular movement 38 of said front wall 34. At least one and preferably two biased latch members 40 are provided extending from the front wall, and at least one and preferably two latch recesses 42 are preferably defined in the left and right walls, arranged such that the latch recesses 42 removably receive the latch members 40 to secure the front wall 34 in a position covering the front opening 16.

Figure 3:
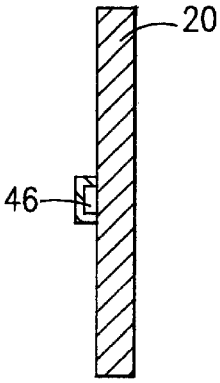
FIG. 3 is a sectional view of a right wall of the receptacle taken at line 3—3 of FIG. 2.
Figure 4:
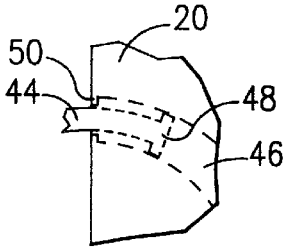
FIG. 4 is a detail view of a guide rail and channel of the right wall.
Figure 5:
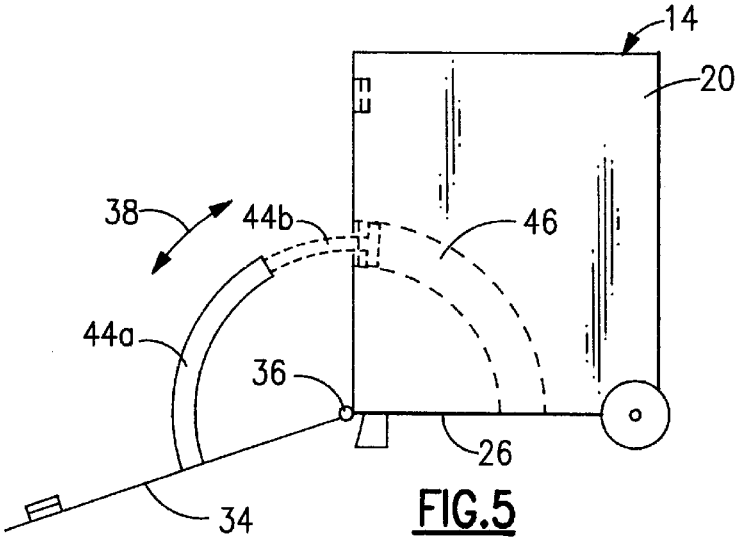
FIG. 5 is a right side view of the receptacle.

At least one and preferably two generally curved guide rails 44 extend from the front wall 34, and at least one and preferably two generally curved guide channels 46 are formed in the right and left walls 20 and 22 to slidingly receive the guide rails 44 to accommodate the angular movement 38 of the front wall 34. As shown in FIG. 3, the guide channels 46 are preferably formed extending from the right and left walls 20 and 22. Optionally, the channels 46 may be formed within the right and left walls 20 and 22 or formed in other arrangements known to those skilled in the art. As shown in FIG. 4, the rails 44 each preferably have an enlarged end portion 48 and the channel 46 each have a narrowed end portion 50. The narrowed portion 50 acts as a stop when the enlarged end portion 48 is slidingly moved into abutment therewith to limit the range of angular movement 38 of the front wall 34. As shown in FIG. 5, the rails 44 may be provided each having two or more telescopic members 44*a*, 44*b* permitting a range of angular movement 38*a* greater than 90 degrees. It should be noted that the receptacle 10 may be provided with any number of guide rails 44 and channels 46, or may be provided without guide rails 44 and channels 46.

Figure 6:
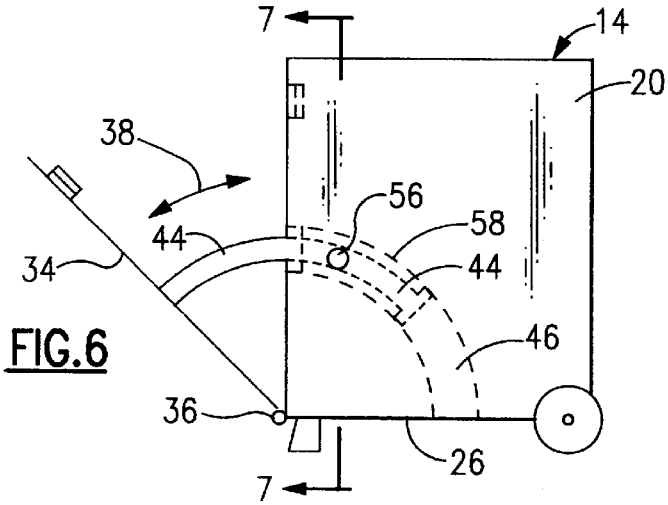
FIG. 6 is a right side view of the receptacle.
Figure 7:
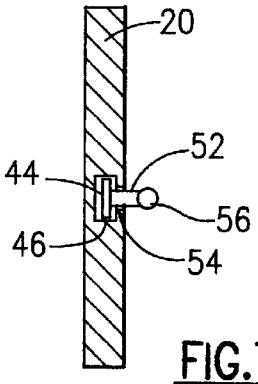
FIG. 7 is a sectional view of a right wall of the receptacle taken at line 7—7 of FIG. 6.

Referring now to FIGS. 6 and 7, at least one arm 52 is preferably provided extending generally perpendicular from each rail 44, and at least one slot 54 is preferably defined in each of the right and left walls 20 and 22 and in communication with each channel 46, wherein each one of the arms 52 is slidingly received in one of the slots 54. A knob 56 or like handle is preferably provided extending from each arm 52 to permit grasping by a user to manually cause the angular movement 38 of the front wall 34. The knob 56 is preferably positioned generally at an intermediate portion 58 of the elongated rail 44 for ease of use, but may optionally be provided at any position along the length of the arm 52. The waste receptacle 10 thereby provides for ease of refuse bag 12 removal by smoothly and stably pivoting the front wall 34 down by manual operation of the knob 56, which operation can performed by all persons.

Figure 8:
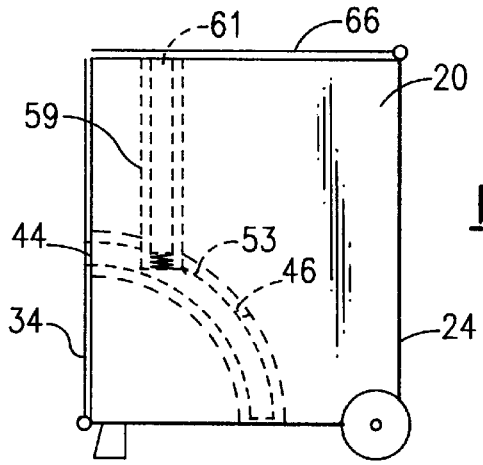
FIG. 8 is a right side view of the receptacle.
Figure 9:
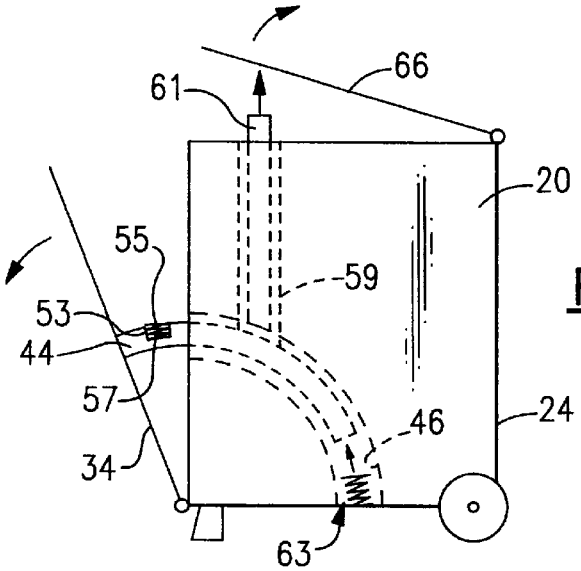
FIG. 9 is a right side view of the receptacle.
Figure 10:
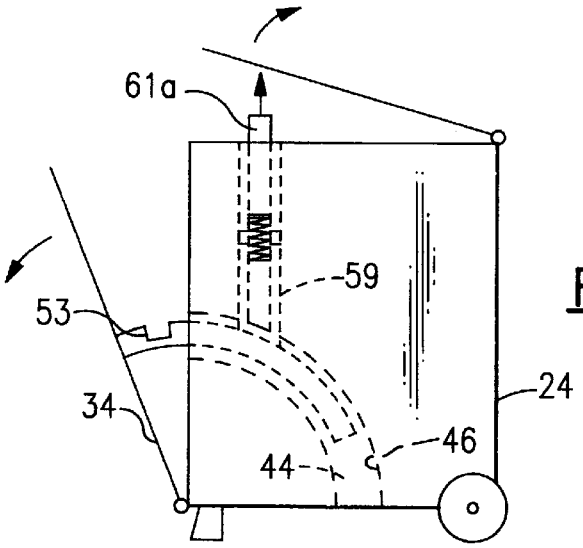
FIG. 10 is a right side view of the receptacle.

Referring now to FIGS. 8 and 9, there may be provided a notch 53 or the like defined in one or both of the rails 44, with a plate 55 or the like and a coil spring 57 or the like disposed within the notch 53. Optionally, other mechanical springs, resilient members, or biasing mechanisms known to those skilled in the art may be suitably employed. The left and/or right wall 20, 22 of the container 14 may have a keeper channel 59 defined therein, the keeper channel 59 in communication with the guide channel 46 and capable of communication with the notch 53. A keeper 61 is arranged within the keeper channel 59 and capable of a sliding movement therein. Optionally, a bar, pin, rod, or other keeper mechanism known to those skilled in the art may be suitably employed. Also, as shown in FIG. 10, the biasing mechanism may be optionally provided as a spring-loaded telescopic member 61*a* capable of extending from the keeper 61 and into the notch 53.

When the front wall 34 and a top wall 66 are in a closed position, the top wall 66 contacts and forces the keeper 61 generally downward into the notch 53 thereby securing the front wall 34 in a closed position. Upon lifting the top wall 66, the spring plate mechanism 55, 57 may then bias the keeper 61 upward and out of the notch 53, thereby allowing the front wall 34 to swing open. It should be noted that a spring plate mechanism 63 or the like may also be provided in the guide channel 46 for biasing the rail 44 to assist in opening the front wall 34.

Figure 11:
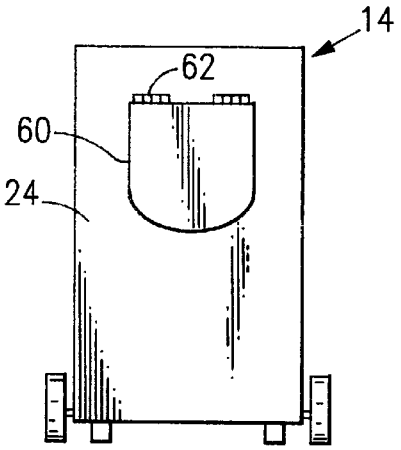
FIG. 11 is a rear view of the receptacle.
Figure 12:
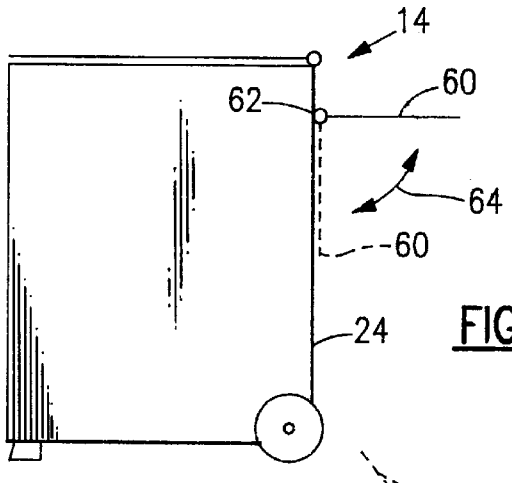
FIG. 12 is a right side view of the receptacle.

Referring now to FIGS. 11 and 12, a rear handle 60 is preferably provided hingedly coupled 62 to the rear wall 24. The hinged coupling 62 permits a range of angular movement 64 of the handle 60 such that the handle 60 may be stored in a position generally proximate to the rear wall 24 and may also be pivoted to a position extending from the rear wall to facilitate a pushing or pulling movement of the container 14.

Figure 13:
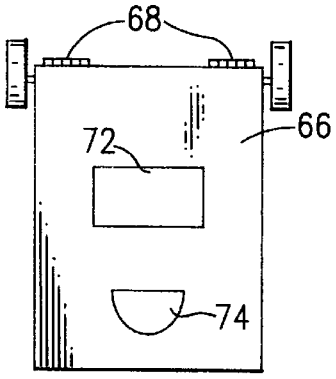
FIG. 13 is a top view of the receptacle.
Figure 14:
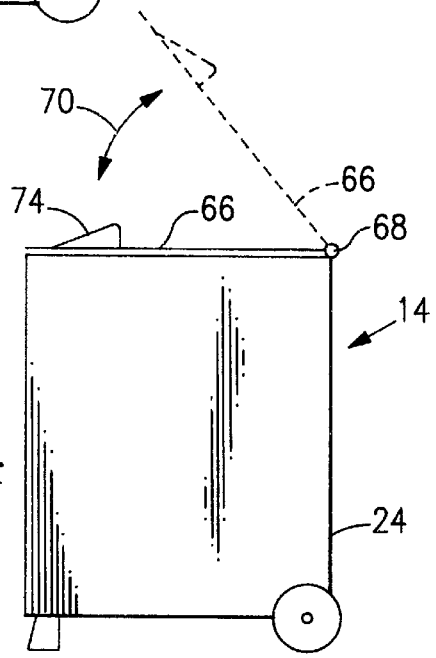
FIG. 14 is a right side of the receptacle.

Referring now to FIGS. 13 and 14, a top wall 66 is provided of a material and construction preferably similar to the container walls 20, 22, 24, 26, and 34, and of a size and shape to substantially cover the top opening 18. The top wall 66 is preferably coupled to the rear wall 24 by at least one hinge 68 or like mechanism permitting a range of angular movement 70 of the top wall 66. The top wall 66 may have an opening 72 defined therein for receiving refuse therethrough and may have a handle 74 formed thereon.

Figure 15:
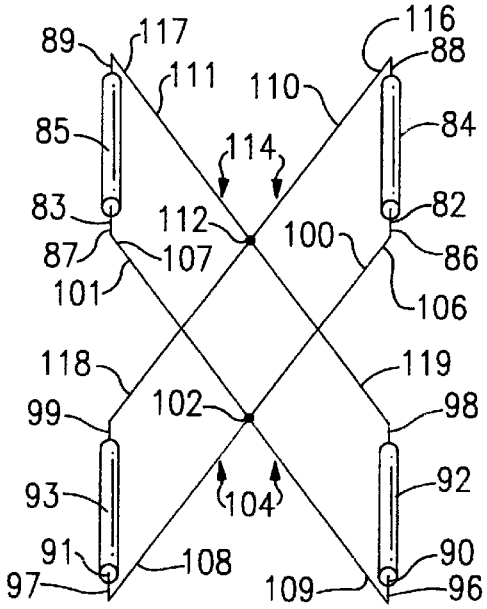
FIG. 15 is a perspective detail view of a cross-bar assembly.
Figure 16:
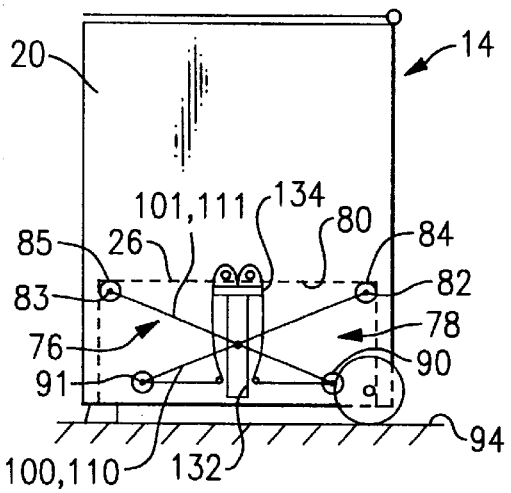
FIG. 16 is a right side detail view of the cross-bar assembly of the receptacle.
Figure 17:
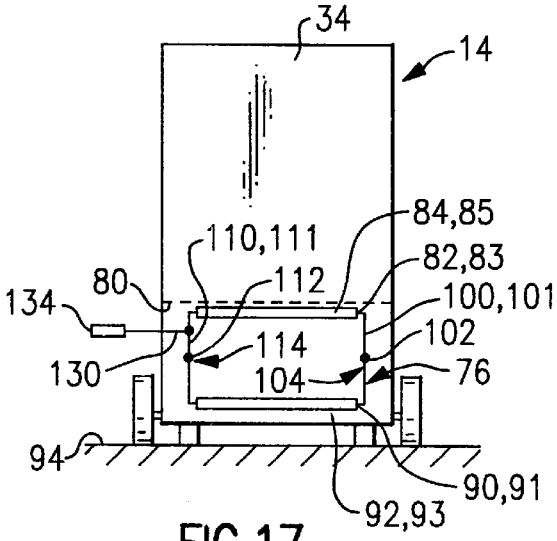
FIG. 17 is a front detail view of the cross-bar assembly of the receptacle.
Figure 18:
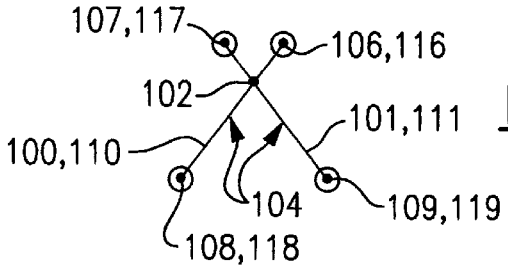
FIG. 18 is a front detail view of an alternative cross-bar assembly.

Referring now to FIGS. 15–17, a cross-bar assembly 76 is preferably provided arranged generally within a bottom recess 78 defined by a bottom side 80 of the bottom wall 26.

The cross-bar assembly 76 preferably comprises two generally parallel top rods 82 and 83 each having a top roller 84, 85 disposed thereabout for rolling engagement of the bottom side 80 of the bottom wall 26. Top rod 82 has a first end 86 and a second end 88, and top rod 83 has a first end 87 and a second end 89. The cross-bar assembly 76 preferably also comprises two generally parallel bottom rods 90 and 91 each having a bottom roller 92, 93 disposed thereabout for rolling engagement of a floor surface 94. Bottom rod 90 has a first end 96 and a second end 98, and bottom rod 91 has a first end 97 and a second end 99.

The cross-bar assembly 76 preferably further comprises a first set of two diagonal rods 100 and 101 pivotally coupled 102 at an intermediate portion 104 of each first diagonal rod 100 and 101. First diagonal rod 100 has a top end 106 coupled to top rod first end 86 and a bottom end 108 coupled to bottom rod first end 97, and first diagonal rod 101 has a top end 107 coupled to top rod first end 87 and a bottom end 109 coupled to bottom rod first end 96. A second set of two diagonal rods 110 and 111 are provided pivotally coupled 112 at an intermediate portion 114 of each second diagonal rod 110 and 111. Second diagonal rod 110 has a top end 116 coupled to top rod second end 88 and has a bottom end 118 coupled to bottom rod second end 99, and second diagonal rod 111 has a top end 117 coupled to top rod second end 89 and has a bottom end 119 coupled to bottom rod second end 98. The intermediate positions 104 and 114 of the first diagonal rods 100 and 101 and of the second diagonal rods 110 and 111 include any position between the corresponding rod ends 106, 107, 108, 109, 116, 117, 118, 119, for example, including the position 104 shown in FIG. 15 which provides a wider base for added stability. All the rods 82, 83, 90, 91, 100, 101, 110, and 111, and the rollers 84, 85, 92 and 93, are preferably made of a thermoplastic resin, a metal, a composite, or another material known to those skilled in the art and selected to provide sufficient strength to support the container 14 with a full load of refuse.

Figure 19:
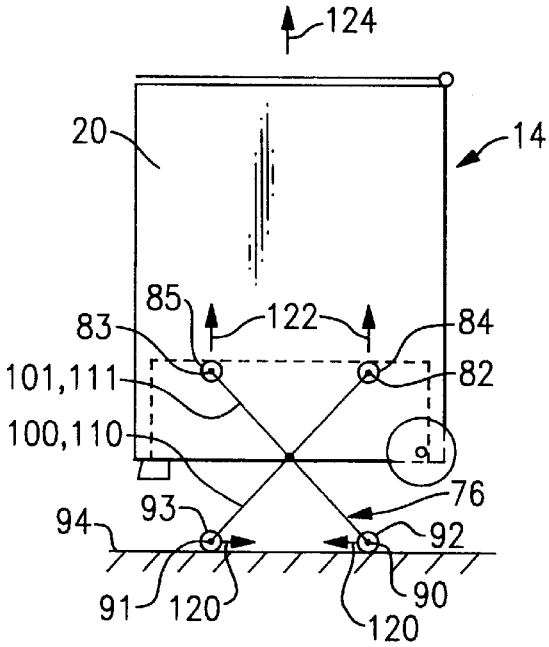
FIG. 19 is a right side detail view of the cross-bar assembly of the receptacle.
Figure 20:
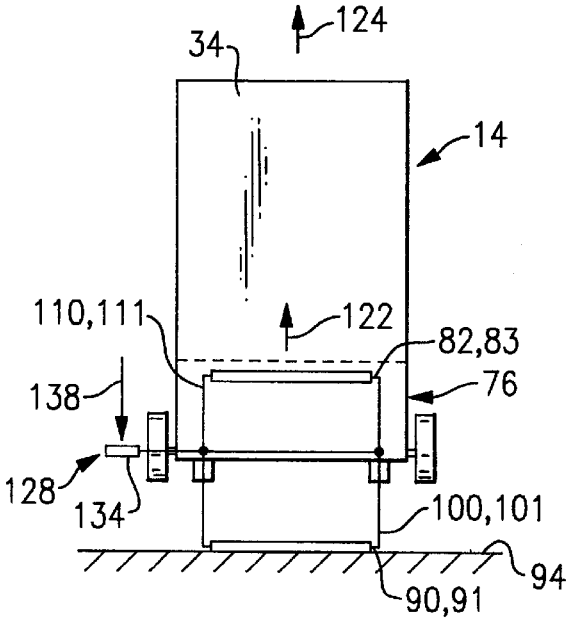
FIG. 20 is a front detail view of the cross-bar assembly of the receptacle.

Referring now to FIGS. 19 and 20, the cross-bar assembly 76 provides a mechanism by which applying to the bottom rods 90 and 91 a force 120 directed inward causes the diagonal rods 100, 101, 110 and 111 to pivot, with the resistance provided by the floor 94 resulting in the top rods 82 and 83 moving generally upward with a force 122 which acts on the bottom side 80 to raise the container 14 with a force 124. The container 14 may descend under the force of its own weight if the force 120 is removed. It should be noted that other structures of a type known to those skilled in the art may be employed to provide a similar result.

Figure 21:
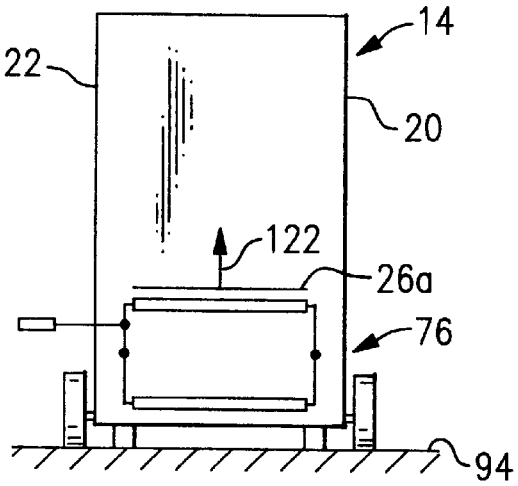
FIG. 21 is a front detail view of a first alternative bottom wall and cross-bar assembly of the receptacle.
Figure 23:
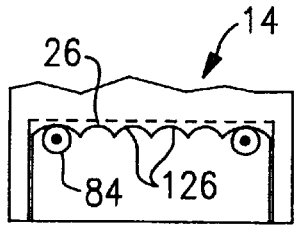
FIG. 23 is a side detail view of a third alternative bottom wall and cross-bar assembly of the receptacle.
Figure 22:
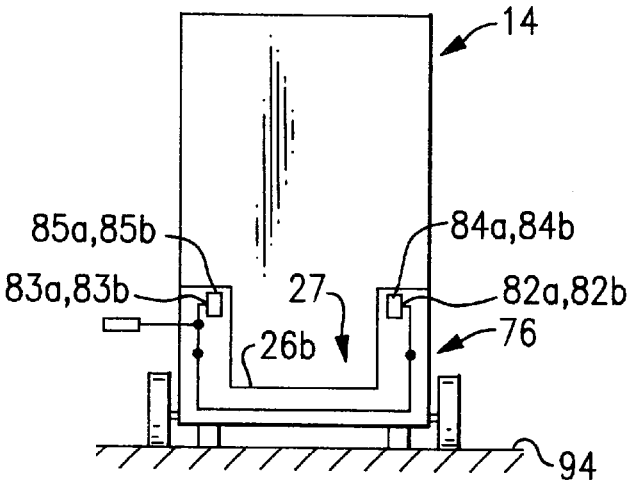
FIG. 22 is a front detail view of a second alternative bottom wall and cross-bar assembly of the receptacle.
Figure 24:
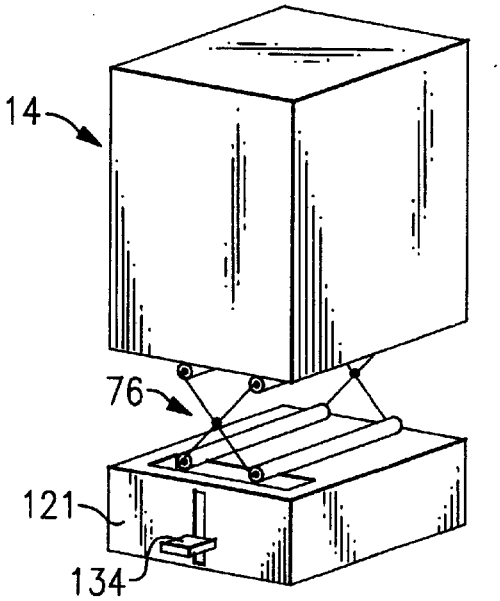
FIG. 24 is a perspective view of a fourth alternative bottom wall, cross-bar assembly, and base of the receptacle.

For example, as shown in FIG. 21, a first alternative provides a bottom wall 26*a* which is free of attachment to the container 14 so as to be vertically moveable therein to serve as a sort of false floor such that the force 122 causes the bottom wall 26*a* to raise while the container 14 remains stationary. A second alternative, as shown in FIG. 22, provides four top rods 82*a*, 82*b*, 83*a*, and 83*b*, each having a roller 84*a*, 84*b*, 85*a*, and 85*b* disposed thereabout, a first two top rods 82*a* and 83*a* being spaced apart and axially aligned, and a second two top rods 82*b* and 83*b* being spaced apart and axially aligned, and a bottom wall 26*b* that has a portion extending downward between said aligned top rods 82*a*, 82*b*, 83*a*, and 83*b* and forming a subjacent space 27 thereto for providing an increased interior space of the container 14. There may also be provided a third alternative including a plurality of slots 126, as shown in FIG. 23, defined in the bottom side 80 of the bottom wall 26 for receiving the top rollers 84 and 85 to provide a ratcheting action when raising or lowering the container 14. A fourth alternative shown in FIG. 24 provides a base 121 for supporting the container 14, with the cross-bar assembly 76 arranged between the base 121 and the container 14.

Figure 25:
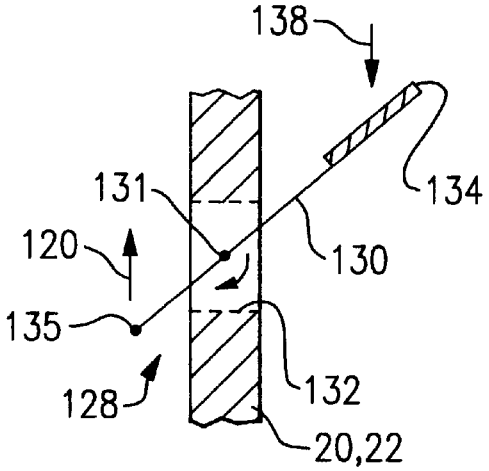
FIG. 25 is a side detail view of an actuator assembly of the receptacle.
Figure 26:
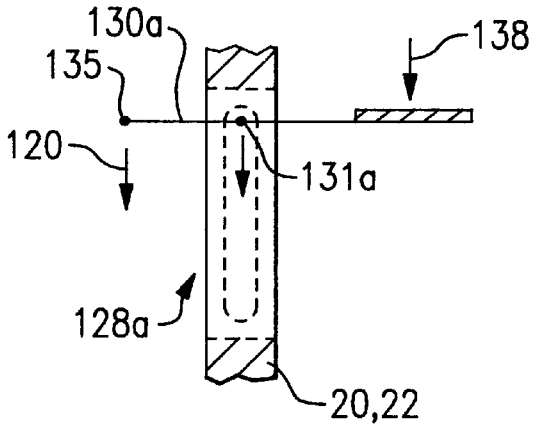
FIG. 26 is a side detail view of an alternative actuator assembly of the receptacle.

Referring now to FIGS. 25 and 26, there is preferably provided an actuator assembly 128 for producing the force 120 on the bottom rods 90 and 91, the actuator assembly 128 comprising a lever 130 extending through and movably coupled 131 to a slot 132 in the right or left wall 20 or 22. The movable coupling 131 preferably includes a rotatable pin or the like for providing a pivotal movement of the actuator 128 (see FIG. 25). Optionally, a movable coupling 13 la may include a sliding pin for providing a generally vertical sliding movement of lever 130*a* of actuator 128*a* (see FIG. 26). A pedal 134 is coupled to the lever 130 which has an end portion 135 which is coupled to a linkage 136 which is coupled to the bottom rods 90 and 91 of the cross-bar assembly 76.

Figure 27:
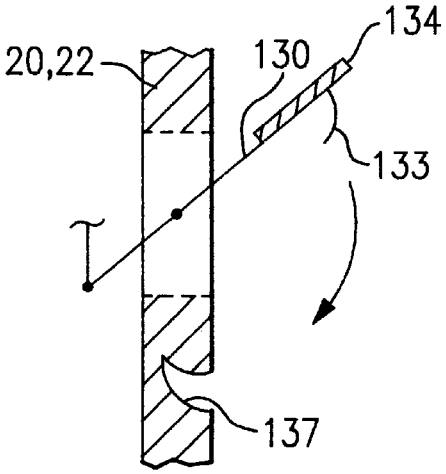
FIG. 27 is a side detail view of the actuator assembly of the receptacle.
Figure 28:
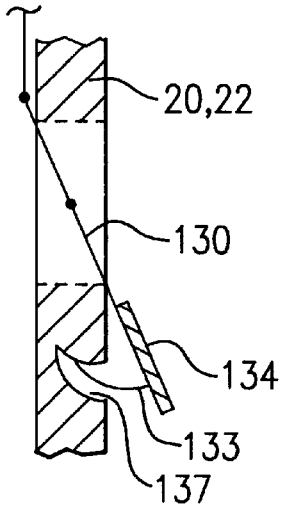
FIG. 28 is a side detail view of the actuator assembly of the receptacle.

Referring now to FIGS. 27 and 28, the actuator assembly 128 may be provided with a self-locking mechanism for maintaining a desired position. For example, a hook 133 or the like may extend from the lever 130 and a groove 137 may be defined in the wall 20 or 22 for receiving the hook 133 when the pedal 134 is depressed. The actuator assembly 128 may thereby be locked in a position to maintain the container 14 in a raised position. Further depressing the pedal 134 allows the hook 133 to release from the groove 137 and thus allows the container 14 to descend under it own weight. It should be noted that many other self-locking mechanisms as are known to those skilled in the art may be suitably employed.

Referring now to FIGS. 29–36, there are a variety of types of linkages 136 which may readily be employed to accomplish the desired result of raising the container 14 by translating the force 138 applied to the pedal 134 into the force 120 on the bottom rods 90 and 91 of the cross-bar assembly 76. For illustration purposes, four such linkages 136*a*–*d* will now be described, though other linkages known to those skilled in the art may be satisfactorily employed.

Figure 29:
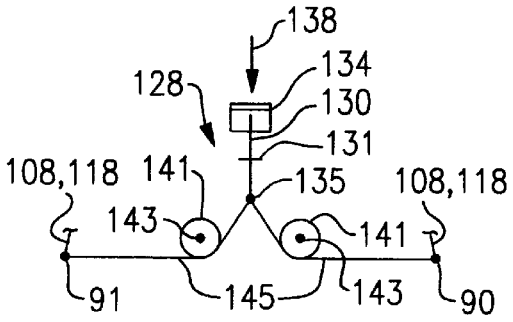
FIGS. 29–36 are side detail views of a preferred and alternative linkage assemblies of the receptacle.
Figure 30:
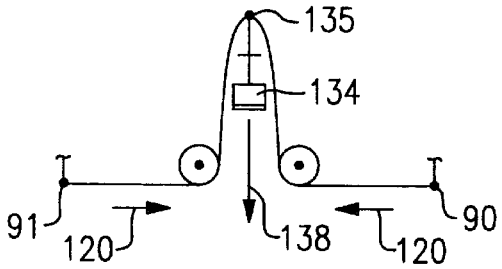

Referring now to FIGS. 29 and 30, there is illustrated a preferred linkage assembly 136*a* comprising at least one and preferably two spools 141 rotationally mounted on axles 143 coupled to the right or left wall 20 or 22. At least one and preferably two generally flexible cords 145 engage the spools 141 and interconnect the lever end 135 and the bottom rods 90 and 91. The result is that when the force 138 is applied to the pedal 134 it moves generally downward and the lever end 135 moves upward, placing the cords 145 under tension and drawing them across and around the spools 141, which in turn causes the force 120 to draw inward the bottom rods 90 and 91 to raise the top ends 82 and 83 and thereby raise the container 14.

Figure 31:
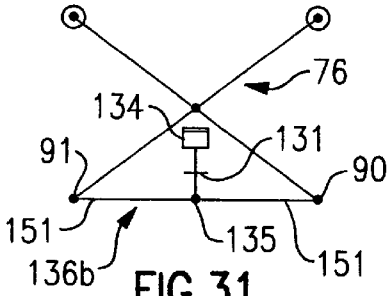
Figure 32:
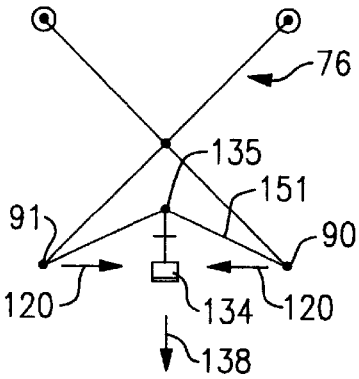

Referring now to FIGS. 31 and 32, there is illustrated a first alternative linkage assembly 136*b* comprising at least one and preferably two rods 151 pivotally coupled to and interconnecting the lever end 135 and the bottom rods 90 and 91. By applying the force 138 on the pedal 134, the rods 151 pivot upward with the lever end 135 and pull inward the bottom rods 90 and 91, thereby achieving the desired result of raising the container 14 as described hereinabove.

Figure 33:
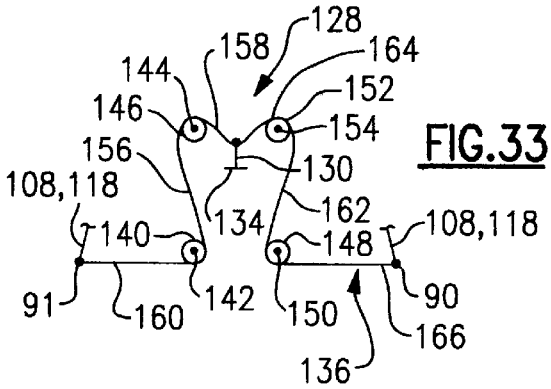
Figure 34:
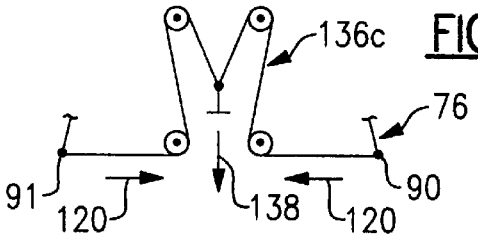

Referring now to FIGS. 33 and 34, there is illustrated a second alternative linkage assembly 136*c* comprising a first lower spool 140 rotationally mounted on an axle 142, a first upper spool 144 rotationally mounted on an axle 146, a second lower spool 148 rotationally mounted on an axle 150, and a second upper spool 152 rotationally mounted on an axle 154. The axles 142, 146, 150 and 154 may be coupled to the right or left wall 20 or 22. A first flexible cord 156 engages the first spools 140 and 144, and has a first end 158 coupled to the lever 130 and a second end 160 coupled to bottom rod 91. A second flexible cord 162 engages the second spools 148 and 152, and has a first end 164 coupled to the lever 130 and a second end 166 coupled to bottom rod 90. The result is that when the force 138 is applied to the pedal 134 it slidingly moves generally downward, placing the first and second cords 156 and 162 under tension and drawing them across and around the spools 140, 144, 148, and 152, which in turn causes the force 120 to draw inward the bottom rods 90 and 91 to raise the top ends 82 and 83 and thereby raise the container 14.

Figure 35:
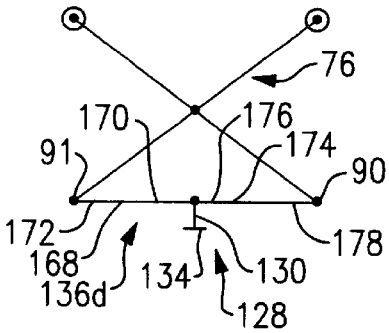
Figure 36:
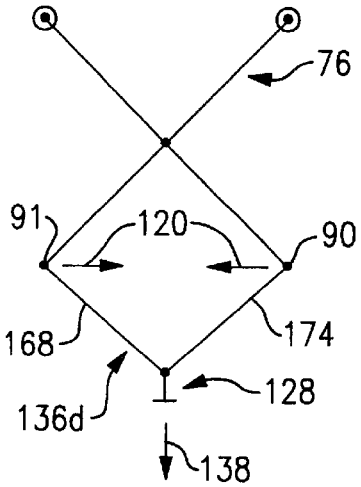

Referring now to FIGS. 35 and 36, there is illustrated a third alternative linkage assembly 136*d* comprising a first rod 168 having a first end 170 pivotally coupled to the lever 130 and a second end 172 pivotally coupled to bottom rod 91. A second rod 174 is provided having a first end 176 pivotally coupled to the lever 130 and a second end 178 pivotally coupled to bottom rod 90. By applying the force 138 on the pedal, the first and second rods 168 and 174 pivot downward with the pedal 134 and pull inward the bottom rods 90 and 91, thereby achieving the desired result of raising the container 14 as described hereinabove.

Figure 37:
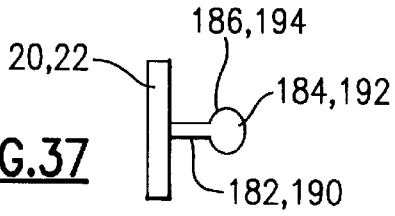
FIG. 37 is a detail view of a preferred fixed arm of the receptacle.
Figure 38:
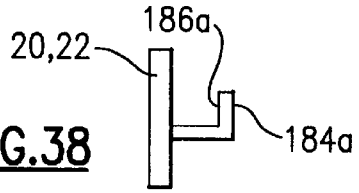
FIG. 38 is a detail view of an alternate fixed arm of the receptacle.

Referring now to FIGS. 37–45, there is preferably provided a bag opener and holder assembly 180 comprising a fixed left arm 182 extending from said left wall 22 and having a catch surface 186 defined thereon. As shown in FIG. 37, the catch surface 186 may be defined on a knob 184. Optionally, a catch surface 186*a* may be defined on an upstanding member 184*a,* as shown in FIG. 38, or on a hook, clamp, pin, or like structure of the type known to those skilled in the art. Similarly, there is also preferably provided a fixed right arm 190 extending from the right wall 20 and having a knob 192 with a catch surface 194 defined thereon, which may be provided in any of the optional forms described above for the left arm 182.

Figure 39:
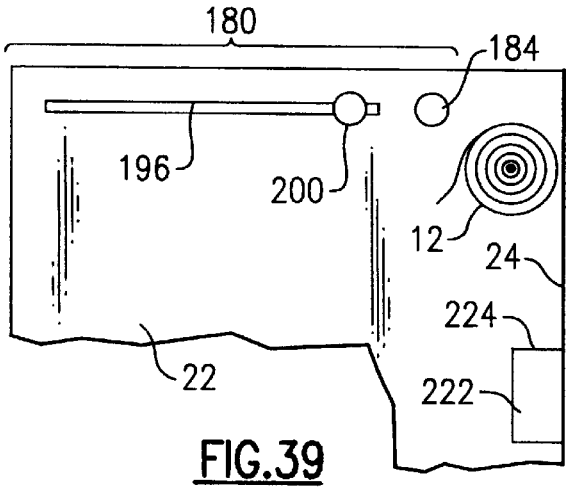
FIG. 39 is a side detail view of the left wall of the receptacle.
Figure 41:
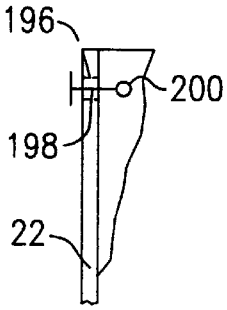
FIG. 41 is a front detail view of a preferred slide arm and opening of the left wall.
Figure 40:
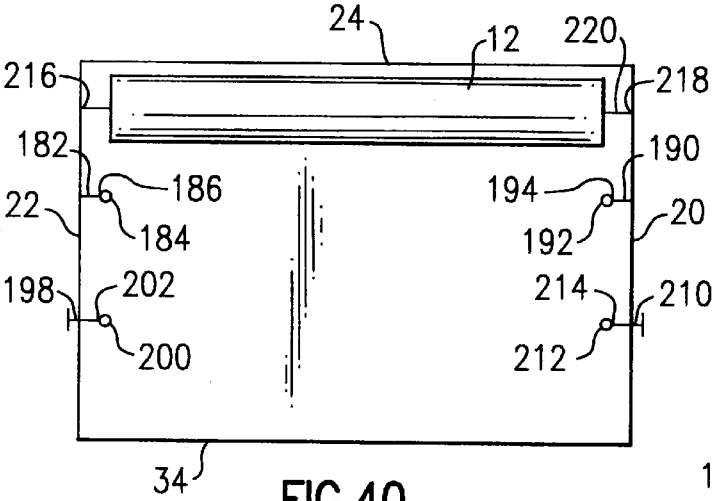
FIG. 40 is a top view of the receptacle.

As shown in FIGS. 39–41, the left wall 22 preferably has a generally horizontal elongated opening 196 defined therein with a left slide arm 198 extending through the opening 196. The slide arm 198 has a knob 200 or the like with a catch surface 202 defined thereon. Similarly, there are preferably provided a generally horizontal elongated opening 206 defined in the right wall 20 with a right slide arm 210 extending therethrough and having a knob 212 with a catch surface 214 defined thereon. The right arm 210 may be provided in any of the optional forms now described for the left arm 198.

Figure 42:
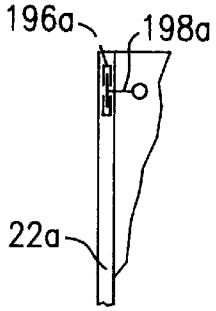
FIG. 42 is a front detail view of a first alternative slide arm and opening of the left wall.
Figure 43:
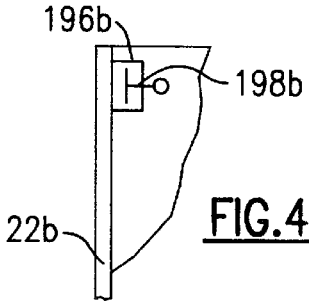
FIG. 43 is a front detail view of a second alternative slide arm and opening of the left wall.
Figure 44:
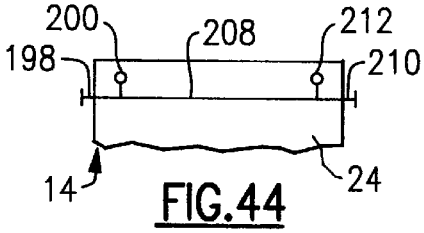
FIG. 44 is a front detail view of a third alternative slide arm of the receptacle.
Figure 45:
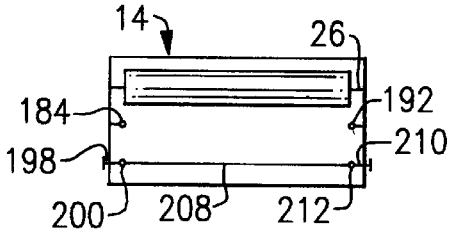
FIG. 45 is a top view of the third alternative slide arm of the receptacle.

As shown in FIG. 42, in a first alternative there is provided a left slide arm 198*a* that slides within a generally horizontal elongated cavity 196*a* defined in a left wall 22*a*. In a second alternative, as shown in FIG. 43, a left slide arm 198*b* may slide within a generally horizontal elongated channel 196*b* extending from a left wall 22*b*. A third alternative, as shown in FIGS. 44 and 45, provides a connecting slide rod 208 may extend between and connect the right and left slide arms 198 and 210, with the knobs 200 and 212 extending generally vertically therefrom. Further alternative fixed and slide arm arrangements of the type known to those skilled in the art may be satisfactorily employed.

The bag opener and holder assembly 180 preferably includes a left bearing surface 216 formed in the left wall 22 and a right bearing surface 218 formed in the right wall 20 and generally aligned with the left bearing surface 216, as shown best in FIGS. 38 and 39. A rod 220 with refuse bags 12 rolled thereabout may thereby be supported by said bearing surfaces 216 and 218 so as to be conveniently positioned with the refuse container 14 for ready use. The rod 220 may be removable for use with non-rolled trash bags 12. There may also be provided a storage compartment 222 formed on the rear wall 24 and having an open top 224 for convenient storage of and access to trash bags 12 and also to sundry items such as twisty-ties, air fresheners, and the like. The compartment 222 is preferably arranged on the upper portion of the rear wall 24 for ease of access thereto.

Figure 46:
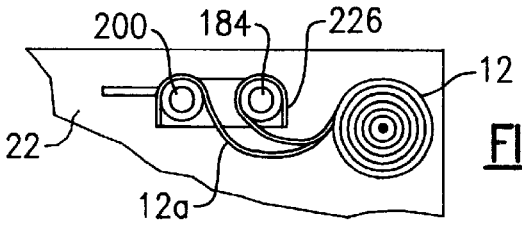
FIG. 46 is a side detail view of the left wall of the receptacle.
Figure 47:
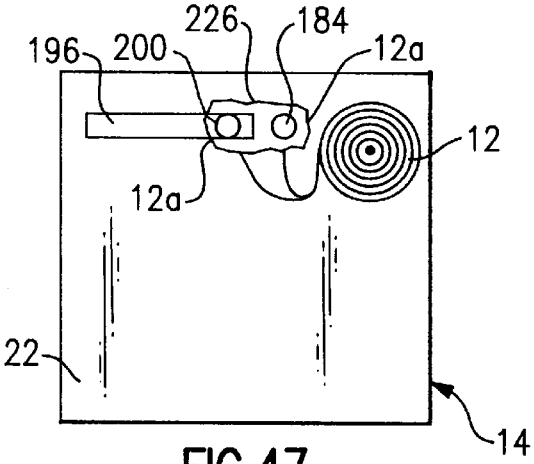
FIG. 47 is a left side view of the left wall.
Figure 48:
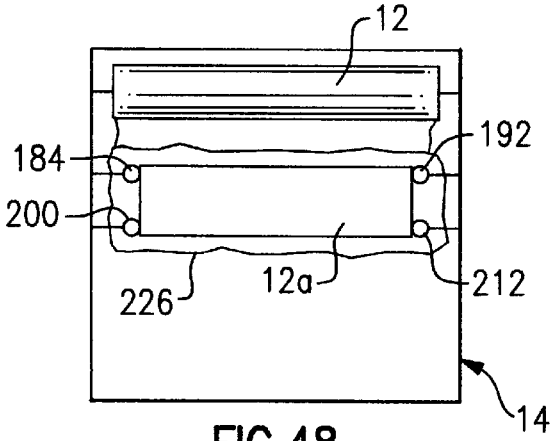
FIG. 48 is a top view of the receptacle.
Figure 49:
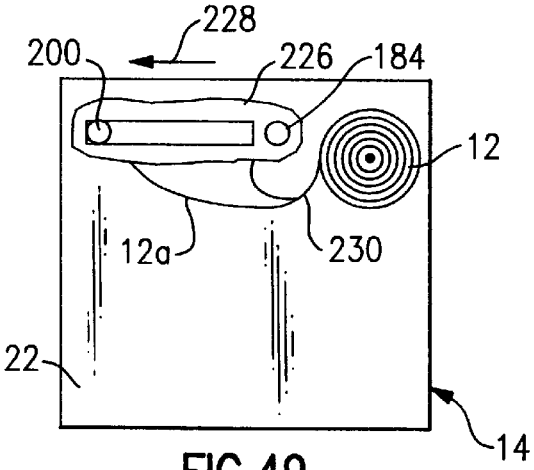
FIG. 49 is a left side view of the left wall.
Figure 50:
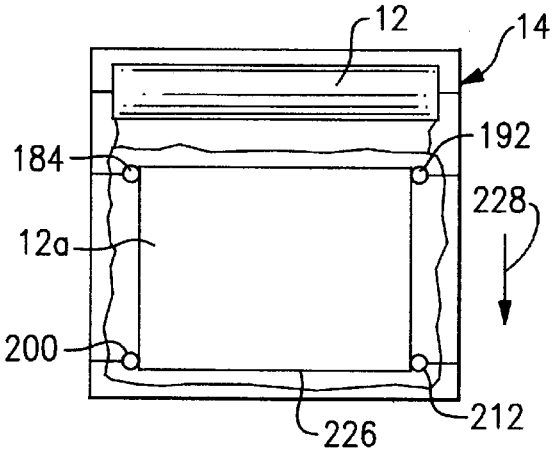
FIG. 50 is a top view of the receptacle.
Figure 51:
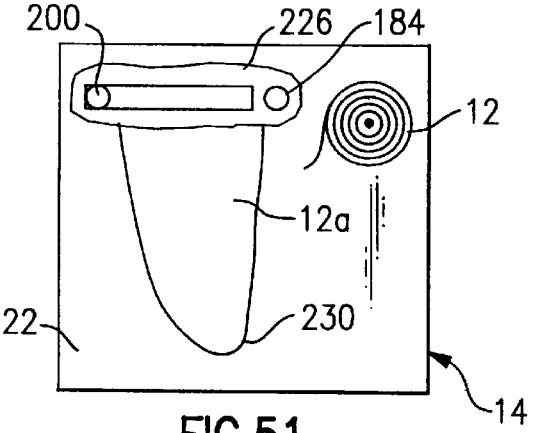
FIG. 51 is a left side view of the left wall.

Referring now to FIGS. 46 through 51, there is illustrated the typical installation of refuse bags 12 in the waste receptacle. As shown in FIG. 46, one of the refuse bags 12*a* of the refuse bag roll 12 is partially unrolled from the rod 220, and a top end 226 of the bag 12*a* is folded over the catch surfaces 186 and 202 of the left knobs 184 and 200. As shown in FIGS. 47 and 48, the top end 226 of the bag 12*a* is then similarly folded over the catch surfaces 194 and 214 of the right knobs 192 and 212 (though this sequence may be modified as desired). As shown in FIGS. 49 and 50, the left slide knob 200 and the right slide knob 212 are moved by a user in a direction 228 generally toward the front of the container 14, thereby easily expanding the bag 12*a* as it is further unrolled. A bottom portion 230 of the bag 12*a* is then separated from the roll 12. As shown in FIG. 51, the bag 12*a* is now open and supported by the knobs 184, 192, 200 and 212. The bag is thus ready to receive refuse through the top opening 18 of the container 14 or through the opening 72 of the top wall 66.

When it is desired to remove the bag 12*a* from the container 14 for disposal, the user swings open the top wall 66 to access the bag 12*a* within the container 14. The user then moves the slide knobs 200 and 212 generally toward the back of the container 14 in the reverse of the procedure described above. The user may then easily collect together the top end 226 of the bag 12*b* to thereby close the bag 12*a* , and may then generally seal the bag 12*a* with a twisty-tie or the like from the compartment 222.

To remove the sealed bag 12*a* from the container 14, the user depresses the pedal 134 of the actuator assembly 128 which operatively engages the linkage assembly 136 to draw inward the bottom rods 90 and 91 of the cross-bar assembly and thereby raise the top rods 82 and 83, which in turn act on the bottom wall 26 to raise the container 14. The user thereby also raises the weighted bag 12*a* to an elevated position such that bending over to lift the weighted bag 12*a* is not necessary. The user may then disengage the latch member 40 from the latch recess 42 and manually move the knob 56 on the guide rail 44 to swing down the front wall 34 such that the user may with little to no physical stress move the weighted bag 12*a* laterally out of the container 14 through the front opening 16. Because the weighted bag 12*a* is then in an elevated position, the user does not have to engage in any lifting activity of the bag 12*a* in order to carry it to a disposal site.

To install another bag 12*a* , the user simply swings the front wall 34 back up to cover the front opening 16. The latch member 40 biases into the latch recess 42 to secure the front wall in place. The above-described procedure for dispensing a new bag 12*a* is then repeated.

Accordingly, there are a number of advantages provided by the present waste receptacle 10. The receptacle 10 provides a mobile, lightweight, and stable container 14 for refuse that may be used and operated by all persons including those persons with limited physical abilities.

Also, the receptacle 10 has a lightweight, hinged front door 34 that smoothly and stably swings down upon manual operation of a knob 56, providing the advantage of ease of refuse bag 12*a* removal by all persons.

Additionally, the receptacle 10 has a cross-bar mechanism 76 with a linkage 136 to a foot pedal 134 such that actuation of the foot pedal 134 engages the cross-bar mechanism 76 to raise the container 14, providing the advantage of easily raising the container 14 to an elevated position to obviate the need to bend over and lift a full refuse bag 12*a* up and out of the container 14, and after such removal of the bag 12*a* from the container 14 the weighted bag 12*a* is in an elevated position such that no lifting is required in order to carry it to a disposal site.

Furthermore, the receptacle 10 typically has two fixed arms 182 and 190 and two sliding arms 198 and 210 arranged within the container 14, providing the advantage of ease of opening and supporting a new refuse bag 12*a* upon disposal of the previous bag 12*a* , and ease of closing the full bag 12*a* for sealing prior to disposal.

While the invention has been described in connection with certain preferred embodiments, it is not intended to limit the scope of the invention to the particular forms set forth, but, on the contrary, it is intended to cover such alternatives, modifications, and equivalents as may be included within the true spirit and scope of the invention as defined by the appended claims. All patents, applications and publications referred to herein are hereby incorporated by reference in their entirety.

What is claimed is:

1. A waste receptacle, comprising:

a. a container with a top opening and a front opening formed by a right wall, a left wall, a rear wall, and a bottom wall;

b. a front wall capable of substantially covering said front opening and hingedly coupled to said bottom wall, said front wall having at least one curved guide rail extending therefrom and at least one of said left and right walls having at least one elongated curved guide channel formed therein and generally in alignment with said rail to slidingly receive said guide rail and permit a range of stable angular movement of said front wall; and, c. a top wall capable of substantially covering said top opening and hingedly coupled to said rear wall to permit angular movement of said top wall.

2. The waste receptacle of claim 1, wherein said rail has an enlarged portion and said channel has a narrowed portion, wherein said narrowed portion acts as a stop to limit said range of angular movement of said front wall.

3. The waste receptacle of claim 1, wherein said rail has at least one arm extending generally perpendicular therefrom and at least one of said left and right walls has a slot defined therein and in communication with said channel, wherein said arm is slidingly received in said slot.

4. The waste receptacle of claim 3, further comprising a knob extending from said arm and positioned generally at an intermediate portion of said elongated rail.

5. The waste receptacle of claim 1, wherein said rail comprises at least two telescopic members permitting said range of angular movement to be greater than 90 degrees.

6. The waste receptacle of claim 1, further comprising at least one notch defined in at least one of said rails, at least one keeper channel defined in at least one of said walls and capable of alignment and communication with said notch, and a keeper slidingly disposed generally within said keeper channel and having at least a portion capable of being slidingly disposed generally within said notch, wherein said keeper is capable of extending from said notch and being contacted by said top wall.

7. The waste receptacle of claim 1, wherein said bottom wall has a bottom side defining a bottom recess in said waste receptacle, and further comprising a cross-bar assembly arranged generally within said bottom recess, the cross-bar assembly comprising:

a. at least two generally parallel top rods each having a roller disposed thereabout for engaging said bottom side of said bottom wall and each having a first and second end, at least two generally parallel bottom rods each having a first and second end, a first set of two diagonal rods pivotally coupled at an intermediate portion of each first diagonal rod, each said first diagonal rod having a top end coupled to one of said top rod first ends and each first diagonal rod having a bottom end coupled to one of said bottom rod first ends, a second set of two diagonal rods pivotally coupled at an intermediate portion of each second diagonal rod, each said second diagonal rod having a top end coupled to one of said top rod second ends and each second diagonal rod having a bottom end coupled to one of said bottom rod second ends;

b. an actuator assembly comprising a lever extending through a slot in at least one of said left and right walls, and a pedal coupled to said lever; and, c. a linkage assembly arranged generally within said recess and coupled to said lever and at least one of said first or second ends of said bottom rods such that depressing said pedal actuates said linkage assembly to pull said bottom ends inward towards each other which causes a raising movement of said top rods against said bottom wall to raise the receptacle.

8. The waste receptacle of claim 1, further comprising a bag opener and holder assembly comprising a fixed right arm having a catch surface formed thereon and extending from said right wall, a generally horizontal elongated opening defined in said right wall, and a right slide arm having a catch surface formed thereon and extending through said right wall opening, a fixed left arm having a catch surface formed thereon and extending from said left wall, a generally horizontal elongated opening defined in said left wall, and a left slide arm having a catch surface formed thereon and extending through said left wall opening.

9. A waste receptacle, comprising:

a. a container having a bottom wall with a bottom side defining a bottom recess in said receptacle;

b. a cross-bar assembly arranged generally within said recess and comprising at least two generally parallel top rods each having a roller disposed thereabout for engaging said bottom side of said bottom wall and each having a first and second end, at least two generally parallel bottom rods each having a first and second end, a first set of two diagonal rods pivotally coupled at an intermediate portion of each first diagonal rod, each said first diagonal rod having a top end coupled to one of said top rod first ends and each first diagonal rod having a bottom end coupled to one of said bottom rod first ends, a second set of two diagonal rods pivotally coupled at an intermediate portion of each second diagonal rod, each said second diagonal rod having a top end coupled to one of said top rod second ends and each second diagonal rod having a bottom end coupled to one of said bottom rod second ends;

c. an actuator assembly comprising a lever extending through a slot in said container, and a pedal coupled to said lever; and, d. a linkage assembly arranged generally within said recess and coupled to said lever and at least one of said first or second ends of said bottom rods, such that depressing said pedal actuates said linkage assembly to pull said bottom ends inward towards each other which causes a raising movement of said top rods against said bottom wall to raise said container.

10. The waste receptacle of claim 9, wherein said linkage assembly comprises at least one spool rotationally mounted on an axle coupled to at least one of said walls and a generally flexible cord engaging said spool and interconnecting said lever and one of said ends of one of said bottom rods.

11. The waste receptacle of claim 9, wherein said linkage assembly comprises a first lower spool, a first upper spool, a second lower spool, and a second upper spool, each of said spools rotationally mounted on axle coupled to said left or right wall, and a first generally flexible cord engaging said first spools and having a first end coupled to said lever and a second end coupled to one of said ends of one of said bottom rods and a second generally flexible cord engaging said second spools and having a first end coupled to said lever and a second end coupled to one of said ends of said other bottom rod.

12. The waste receptacle of claim 9, wherein said linkage assembly comprises at least one rod coupled to said lever and to one of said ends of one of said bottom rods.

13. The waste receptacle of claim 9, wherein said linkage assembly comprises a first rod having a first end coupled to said lever and a second end coupled to one of said ends of one of said bottom rods, and a second rod having a first end coupled to said lever and a second end coupled to one of said ends of said other bottom rod.

14. The waste receptacle of claim 9, wherein said top rods comprise four rods each having a roller disposed thereabout, a first two of said top rods being spaced apart and axially aligned and a second two of said top rods being spaced apart and axially aligned, and wherein said bottom wall comprises a portion extending downward between said aligned top rods and forming a subjacent space thereto for providing an increased space within said container for refuse.

15. The waste receptacle of claim 9, wherein said bottom bars each have a roller disposed thereabout.

16. The waste receptacle of claim 9, wherein said bottom wall is free of attachment to said container so as to be vertically moveable within said container.

17. The waste receptacle of claim 9, further comprising a base supporting said cross-bar assembly and said container.

18. The waste receptacle of claim 9, further comprising at least one hook associated with said pedal and at least one groove defined in at least one of said walls and capable of receiving said hook.

19. The waste receptacle of claim 9, wherein said container has a front wall hingedly coupled to said bottom wall to permit a range of angular movement of said front wall.

20. The waste receptacle of claim 9, wherein said container has a said top wall hingedly coupled to a rear wall to permit angular movement of said top wall.

21. The waste receptacle of claim 9, further comprising a bag opener and holder assembly comprising a fixed right arm having a catch surface formed thereon and extending from a right wall, a generally horizontal elongated opening defined in said right wall, a right slide arm having a catch surface formed thereon and extending through said right wall opening, a fixed left arm having a catch surface formed thereon and extending from a left wall, a generally horizontal elongated opening defined in said left wall, and a left slide arm having a catch surface formed thereon and extending through said left wall opening.

22. A waste receptacle, comprising:

a. a container with a top opening formed by a right wall, a left wall, a rear wall, a front wall, and a bottom wall;

b. a top wall removably coupled to said container; and, c. a bag opener and holder assembly comprising a fixed right arm having a catch surface formed thereon and extending from said right wall, a generally horizontal elongated opening defined in said right wall, a right slide arm having a catch surface formed thereon and extending through said right wall opening, a fixed left arm having a catch surface formed thereon and extending from said left wall, a generally horizontal elongated opening defined in said left wall, and a left slide arm having a catch surface formed thereon and extending through said left wall opening.

23. The waste receptacle of claim 22, wherein said catch surfaces of said fixed and slide arms are formed on knobs.

24. The waste receptacle of claim 22, further comprising a slide rod extending between and connecting said right and left slide arms.

25. The waste receptacle of claim 22, further comprising a right bearing surface formed in said right wall and a left bearing surface formed in said left wall and generally aligned with said right bearing surface, wherein a rod with refuse bags disposed thereabout may be supported by said bearing surfaces.

26. The waste receptacle of claim 22, further comprising a storage compartment formed within said container, said compartment extending from said rear wall and having an open top.

27. The waste receptacle of claim 22, wherein said front wall is hingedly coupled to said bottom wall to permit a range of angular movement of said front wall.

28. The waste receptacle of claim 22, wherein said bottom wall has a bottom side defining a recess in said receptacle, and further comprising a cross-bar assembly arranged generally within said recess, said cross-bar assembly comprising:

a. at least two generally parallel top rods each having a roller disposed thereabout for engaging said bottom side of said bottom wall and each having a first and second end, at least two generally parallel bottom rods each having a first and second end, a first set of two diagonal rods pivotally coupled at an intermediate portion of each first diagonal rod, each said first diagonal rods having a top end coupled to one of said top rod first ends and each first diagonal rod having a bottom end coupled to one of said bottom rod first ends, a second set of two diagonal rods pivotally coupled at an intermediate portion of each second diagonal rod, each said second diagonal rod having a top end coupled to one of said top rod second ends and each second diagonal rod having a bottom end coupled to one of said bottom rod second ends;

b. an actuator assembly comprising a lever extending through a slot in at least one of said left and right walls, and a pedal coupled to said lever; and, c. a linkage assembly arranged generally within said recess and coupled to said lever and at least one of said first or second ends of said bottom rods such that depressing said pedal actuates said linkage assembly to pull said bottom ends inward towards each other which causes a raising movement of said top rods against said bottom wall to raise the container.

29. A waste receptacle, comprising:

a. a container with a front opening and a top opening formed by a right wall, a left wall, a rear wall, and a bottom wall, said bottom wall having a bottom side defining a bottom recess in said receptacle;

b. a front wall capable of substantially covering said front opening and hingedly coupled to said bottom wall, said front wall having at least one curved guide rail extending therefrom and at least one of said left and right walls having at least one elongated curved guide channel formed therein which slidingly receives said guide rail to permit a range of stable angular movement of said front wall;

c. a top wall capable of substantially covering said top opening and removably coupled to said container;

d. a cross-bar assembly arranged generally within said bottom recess and comprising at least two generally parallel top rods each having a roller disposed thereabout for engaging said bottom side of said bottom wall, each top rod having a first and second end, at least two generally parallel bottom rods each having a first and second end, a first set of two diagonal rods pivotally coupled at an intermediate portion of each first diagonal rod, each said first diagonal rod having a top end coupled to one of said top rod first ends and each first diagonal rod having a bottom end coupled to one of said bottom rod first ends, a second set of two diagonal rods pivotally coupled at an intermediate portion of each second diagonal rod, each said second diagonal rod having a top end coupled to one of said top rod second ends and each second diagonal rod having a bottom end coupled to one of said bottom rod second ends;

e. an actuator assembly comprising a lever extending through a slot in at least one of said left and right walls, and a pedal coupled to said lever;

f. a linkage assembly arranged generally within said recess and coupled to said lever and at least one of said first or second ends of said bottom rods such that depressing said pedal actuates said linkage assembly to pull said bottom ends inward towards each other which causes a raising movement of said top rods against said bottom wall to raise the container; and, g. a bag opener and holder assembly comprising a fixed right arm having a catch surface formed thereon and extending from said right wall, a generally horizontal elongated opening defined in said right wall, and a right slide arm having a catch surface formed thereon and extending through said right wall opening, and a fixed left arm having a catch surface formed thereon and extending from said left wall, a generally horizontal elongated opening defined in said left wall, and a left slide arm having a catch surface formed thereon and extending through said left wall opening.

30. The waste receptacle of claim 29, wherein said bottom side of said bottom wall has at least two slots defined therein for receiving said rollers of said top rods.

31. The waste receptacle of claim 29, further comprising a handle hingedly coupled to said rear wall.

32. The waste receptacle of claim 29, further comprising at least two wheels rotatably mounted on axle extending through said container and at least one foot extending from said bottom wall.

33. The waste receptacle of claim 29, further comprising at least one latch member extending from said front wall and at least one latch recess defined in at least one of said left and right walls, wherein said latch recess removably receives said latch member.

34. The waste receptacle of claim 29, wherein said top wall has an opening defined therein for receiving refuse therethrough and has a handle formed thereon.

35. The waste receptacle of claim 29, further comprising at least one notch defined in at least one of said rails, at least one keeper channel defined in at least one of said walls and capable of alignment and communication with said notch, and a keeper slidingly disposed generally within said keeper channel and having at least a portion capable of being slidingly disposed generally within said notch, wherein said keeper is capable of extending from said notch and being contacted by said top wall.

36. The waste receptacle of claim 29, further comprising a base supporting said cross-bar assembly and said container.

37. The waste receptacle of claim 29, further comprising at least one hook associated with said pedal and at least one groove defined in at least one of said walls and capable of receiving said hook.

* * * * *